US006357274B1

(12) United States Patent
Tanaka et al.

(10) Patent No.: US 6,357,274 B1
(45) Date of Patent: Mar. 19, 2002

(54) SPARKPLUG MANUFACTURING METHOD

(75) Inventors: Kazuhiko Tanaka, Kuwana; Hirofumi Nishiwaki, Suzuka, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/692,139

(22) Filed: Oct. 20, 2000

(30) Foreign Application Priority Data

Oct. 21, 1999 (JP) ..... 11-300209

(51) Int. Cl.[7] ..... B21K 21/08
(52) U.S. Cl. ..... 72/356; 72/355.6
(58) Field of Search ..... 72/356, 355.6

(56) References Cited

U.S. PATENT DOCUMENTS 3,759,080 A * 9/1973 Sugahara et al. ..... 72/356
4,291,568 A * 9/1981 Stifano, Jr. ..... 72/356
4,352,283 A * 10/1982 Bailey ..... 72/356
5,088,311 A 2/1992 Inoue

FOREIGN PATENT DOCUMENTS

JP 7-16693 1/1995

* cited by examiner

*Primary Examiner*—Lowell A. Larson
(74) *Attorney, Agent, or Firm*—Pillsbury Winthrop

(57) ABSTRACT

A manufacturing method is provided that produces a tubular metallic shell for spark plugs. The metallic shell has a tapered part in the outer periphery to provide a seal. The tapered part can be formed into a desired shape by cold forging operation. A first processed part has a first tapered part with a tapering angle A formed in the first processing step. In the second processing step, the first tapered part is transformed into a second tapered part having a tapering angle B. This is accomplished by utilizing a stepped inner cavity with a second molding die with a tapered bearing surface having a tapering angle B which is greater than the tapering angle A. In the third processing step, the second tapered part is transformed into a third tapered part with a tapering angle C. This is accomplished by utilizing a stepped inner cavity with a third molding die with a tapered bearing surface having a tapering angle C which is smaller than the tapering angle B. It also utilizes a third punch having a tip part whose outer diameter is smaller than the outer diameter of the small diameter foot part of the second processed part.

5 Claims, 7 Drawing Sheets

SPARKPLUG MANUFACTURING METHOD

CROSS-REFERENCE TO RELATED APPLICATION

The present invention is related to Japanese patent application No. Hei. 11-300209, filed Oct. 21, 1999; the contents of which are incorporated herein by reference.

FIELD OF THE INVENTION

The present invention is related to a manufacturing method, and more particularly, to a manufacturing method for manufacturing metallic shells for spark plugs used in internal combustion engines such as those in automobiles.

BACKGROUND OF THE INVENTION

A conventional method for manufacturing metallic shells for spark plugs is shown in FIGS. 9A–9G. Here, material processed, J1 through J6, shown in FIG. 9A through FIG. 9F, are formed by a cold forging operation using a molding die and a punch, for example as described in Japanese Laid Open Patent No. Hei-7 16693, 1995.

In other words, a stepped columnar material J2 is formed from a columnar material J1 by a cold forging operation. Next, material J3 having a large diameter head part J8 forming a large diameter hole, and a small diameter foot part J9 forming a smaller diameter hole is formed. The large diameter head part J8 and small diameter foot part J9 are stretched to successively form parts J4, and J5. Then, the interior of the material is bored to form part J6.

The step portion J10 located between the large diameter head part and the small diameter foot part in the material J6 is processed by a cutting operation to produce the tapered part J11 as shown in FIG. 9G. The threaded part J12 is produced by a rolling operation and the final finished product of a metallic shell J7 is produced. The metallic shell J7 is attached to the engine head by means of the threaded part J12. The tapered part J11 is tightly attached to the engine head to provide a seal between the spark plug and the engine head.

The tapered part produced by this type of cutting process, however, is a result of secondary process applied to a cold forged product. Consequently, it is necessary to make frequent checks on the processes and frequent exchange of cutting tools, to consistently obtain the exact shape. The requirements for the angle of the tapered part, deflection of the axis, and surface roughness are being maintained in this manner. Therefore, as the cutting tool approaches the end of its service life, accuracy of the finished product suffers. Additionally, there have been strong demands in recent years for lower costs, easier way to manage the tapered part, and improved consistency of the shape of the finished products in the manufacturing of metallic shells. The present invention was developed in light of these and other drawbacks.

SUMMARY OF THE INVENTION

The present invention provides a manufacturing method of producing a tubular metallic shell for a spark plug having a tapered outer periphery to provide a seal. The desired shape of the tapered part is produced by cold forging. A tubular metallic shell of a spark plug has a stepped tapered part in its outer periphery, between a larger diameter part and a small diameter part. This is to provide a seal when tightly attached to the engine head. The tapered part is formed by cold forging. The cold forging operation is performed by the processing steps include the following.

(a) In the first processing step, a first molding die having a stepped inner cavity that forms a tapered bearing surface between the lager diameter part and the small diameter part, is prepared. As a columnar material is secured in the stepped inner cavity of the first molding die, a first punch is pressed against the material in the axial direction to transform its shape. Consequently, a first processed part having a stepped columnar shape is formed. It comprises a large diameter head part with a large diameter hole opened at one end, and a small diameter foot part positioned at the other end. The small diameter foot part has a smaller outer diameter than the large diameter head part. In addition, a first tapered part located at the boundary between said large diameter head part and said small diameter foot part is formed.

(b) In the second processing step, a second molding die having a stepped inner cavity that forms a tapered bearing surface at the boundary between the large diameter part and the small diameter part is prepared. The tapered bearing surface has a greater tapering angle B than the tapering angle A in the first tapered part. A second punch having a larger outer diameter than the outer diameter of the small diameter foot part of the first processed part, described above, is also prepared. As the first processed part, mentioned above, is secured in the stepped inner cavity of the second molding die, the second punch is inserted into the larger diameter hole in the first processed part, and pressed in the axial direction. Consequently, the shape of said first tapered part is transformed to conform to the bearing surface of the second die. Thus, a second processed part having a stepped columnar shape, and a second tapered part with the tapering angle B, described above, is formed.

(c) In the third processing step, a third molding die having a stepped inner cavity that forms a tapered bearing surface at the boundary between the large diameter part and the small diameter part is prepared. The tapered bearing surface has a smaller tapering angle C than the tapering angle B in the second tapered part. A third punch with a tip having a smaller outer diameter than that of the small diameter foot part of the second processed part, described above, is also prepared. As the second processed part, mentioned above, is secured in the stepped inner cavity of the third molding die, the third punch is inserted into the large diameter hole in the second processed part, and pressed in the axial direction. Consequently, the shape of said second tapered part is transformed to conform to the bearing surface of the third molding die. Thus, a third processed part having a stepped columnar shape and a third tapered part with the tapering angle C, described above, is formed.

The tapering angles A, B, and C, refers to the angles formed between the axial direction of each processed part or stepped inner cavity, and the inclination angles of each processed material's outer surface or each inner cavity's inner surface. The axial direction in each processed part and each stepped inner cavity is defined as 0°. This is illustrated in FIG. 5 and FIG. 6, explained later.

In the third processing step, the shape of the second tapered part is transformed to conform to the bearing surface (thereafter called the third bearing surface) of the stepped inner cavity of the third molding die. The third bearing surface has a tapering angle C that is smaller than the tapering angle B of the second tapered part.

In the second processing step, the second punch having a larger outer diameter than the outer diameter of the small diameter foot part of the first processed part is used, as shown in FIG. 5. Therefore, the pressure exerted onto the first processed part is directly conveyed to the first tapered part. However, in the third processing step, a third punch, having a tip with an outer diameter smaller than the outer diameter of the small diameter foot part of the second processed part, is used. This is illustrated in FIG. 6. Therefore, the pressure exerted onto the second processed part is conveyed directly to the small diameter foot part of the second processed part, but not directly to the second tapered part.

In this process, the second tapered part is stretched by the transformation of the small diameter foot part, and the third tapered part is formed as a final tapered part. In the third processing step, the configuration of pressure applied at the tapered part is different from that of the second processing step. Therefore, although the tapering angle C is smaller than the tapering angle B, the lubricating oil is less likely to be retained.

In another aspect, the third molding die is pushed in a direction opposite from the direction of pressure applied by the third punch, in the third processing step. The third tapered part and the third bearing surface are forced to remain in contact even after the tapered part is formed by this arrangement. Preferably, the tapering angle B is greater than the tapering angle A by 1° to 10°. This is because when the difference in the two tapering angles is less than 1°, escape of the lubricating oil is blocked. When the difference in the two tapering angles is more than 10°, the amount of lubricating oil retained between the first tapered part and the second bearing surface becomes so great that it is difficult to discharge it properly. Also, preferably, the tapering angle C smaller is than the tapering angle B by 0.5° to 5°, as described in Claim 4 of the Patent Claims. Here, when the difference between the two tapering angles is less than 0.50°, the second tapered part undergoing transformation may become severed by the pressure of the third punch. When the difference between the tapering angles B and C is greater than 5°, the amount of lubricating oil retained between the first tapered part and the second bearing surface becomes so much, it is difficult to discharge it properly.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DESCRIPTION OF THE PREFERRED EMBODIMENTS

Figure 1:
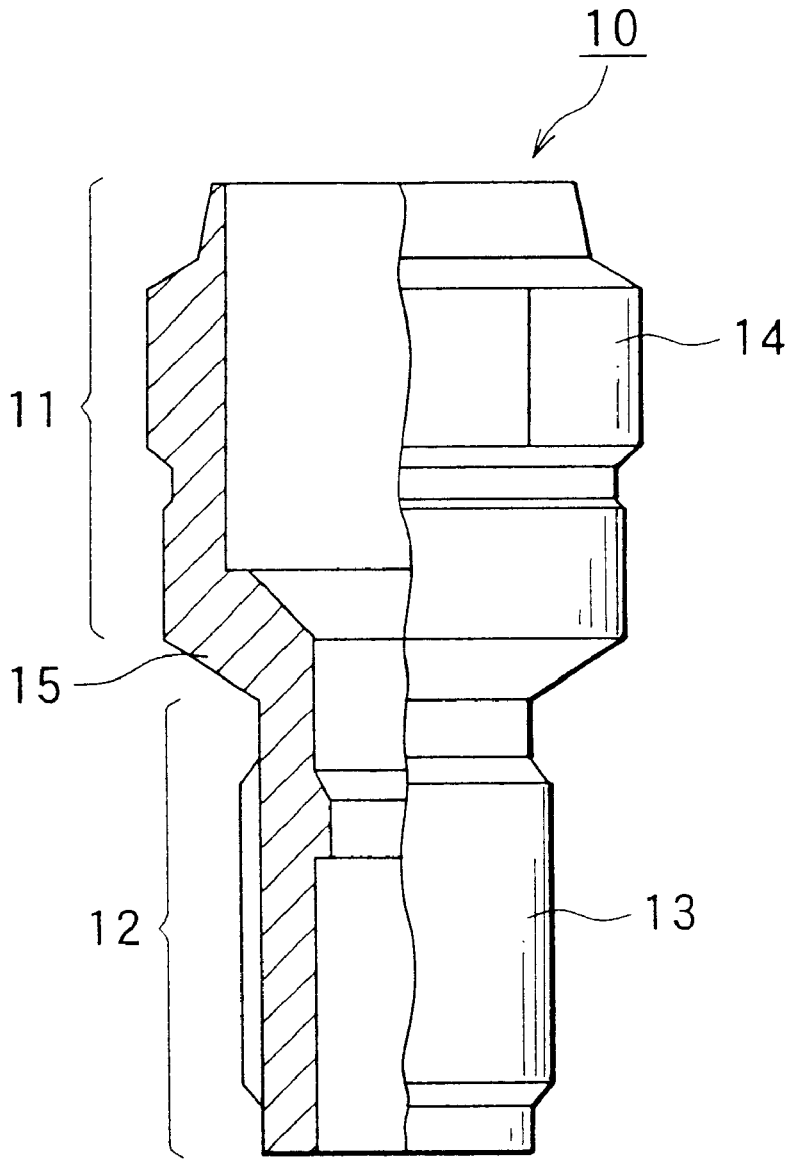
FIG. 1 is a partial cross-sectional view of a finished metallic shell of spark plug produced by a method for making metallic shells for sparkplugs according to the present invention.
Figure 2:
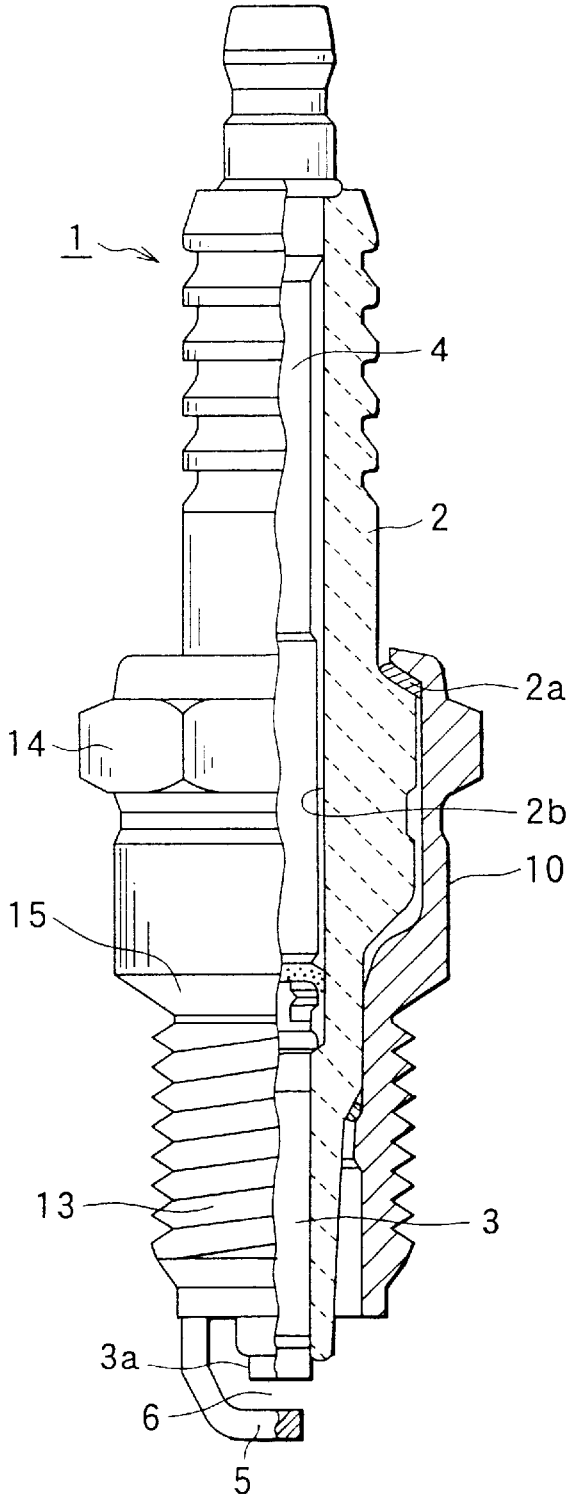
FIG. 2 is a partial cross-sectional view of a spark plug assembled with a process for making metallic shells for sparkplugs according to the present invention.

In FIG. 1 and FIG. 2, the metallic shell 10 has a stepped tubular shape. Metallic shell 10 has a large diameter part 11 located at one end, and a small diameter part 12 having an outer diameter smaller than that of the large diameter part 11 located at the other end. It is composed of a conductive steel material (for example, low carbon steel). A threaded part 13 is formed on the outer periphery of the small diameter part 12 to screw into a threaded hole (not shown in the figure) provided in the engine head (not shown in the figure). A hexagonal part 14 is formed on the outer periphery of the large diameter part 11 surrounding the axis to provide means to apply axial force to tighten the screw coupling.

A tapered part (taper seat part) 15, formed in a tapering step, is formed in the outer periphery of the metallic shell 10 between the large diameter part 11 and the small diameter part 12. The tapered part 15 is shaped as a ring surrounding the axis. The tapered part 15 is tightly attached to the tapered bearing surface (not shown in the figure) formed on the inside surface of the screw hole, mentioned above, by the axial force of screw coupling to provide a seal.

In a spark plug assembled with the metallic shell 10, a tubular insulator 2 composed of alumina ceramics ($Al_2O_3$) or other similar material is held in the inner hole of the metallic shell 10. Each end of the insulator 2 is exposed from each end of the metallic shell 10. The step formed in the insulator 2 is caulked and fixed to one end of the metallic shell 10 with packing material 2*a*.

A tubular center electrode 3 and its stem 4 are secured in the inner hole 2*b* of the insulator 2. The tip 3*a* of the center electrode 3 is exposed from the inner hole 2*b* of the insulator 2. The back end of the center electrode 3 is electrically connected to the stem 4 inside the inner hole 2*b*. A ground electrode 5 is attached to one end of the metallic shell 10 by means such as welding. The ground electrode 5 is bent in the middle forming an L shape. It faces the tip 3*a* of the center electrode 3, at the opposite end from the welded position, separated by a discharge gap 6.

Figure 3A:
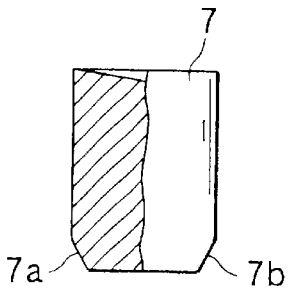
FIG. 3A is a partial cross-sectional view of a piece formed with a processing step of a method for making metallic shells for sparkplugs according to the present invention.

Next, the manufacturing method of the metallic shell by cold forging related to this invention will be described referring to FIGS. 3A–3F and FIGS. 4A–4C. FIGS. 3A–3F shows the status of each processing step of the cold forging operation of the metallic shell 10. It shows the cross section of each part corresponding to the cross section shown in FIG. 1. First, a tubular metal material, for example low carbon steel, is placed in the first forming station (not shown in the figure) of a cold forging machine, as shown in FIG. 3A. A round bullet shaped forged product 7 is produced by swaging. The outer periphery of the bottom end of the forged product 7 is rounded to form an arc shaped corner 7*a*.

Figure 8:
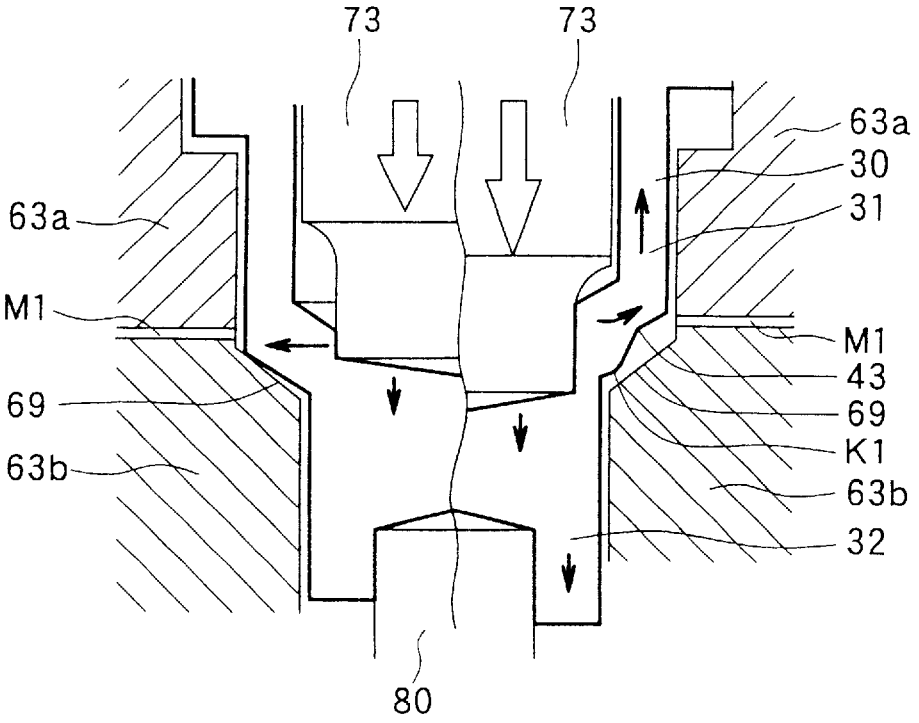
FIG. 8 shows the problems encountered if the moving mechanism is not provided in a method for making metallic shells for sparkplugs according to the present invention.
Figure 9A:
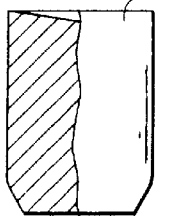
FIG. 9A PRIOR ART
FIG. 9 is a partial cross-sectional views of the processing status of each manufacturing step made to produce a conventional metallic shell.
Figure 9B:
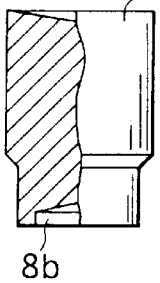
FIG. 9B PRIOR ART
Figure 9C:
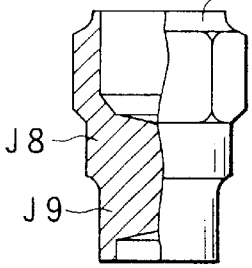
FIG. 9C PRIOR ART
Figure 9D:
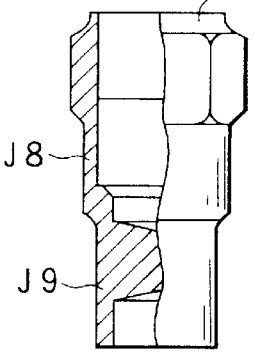
FIG. 9D PRIOR ART
Figure 9E:
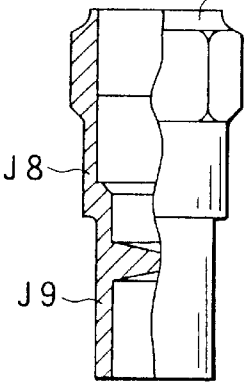
FIG. 9E PRIOR ART
Figure 9F:
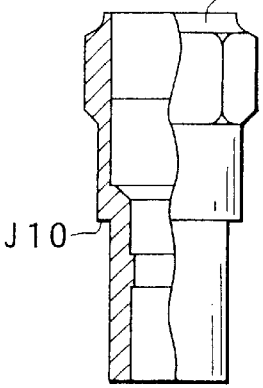
FIG. 9F PRIOR ART
Figure 9G:
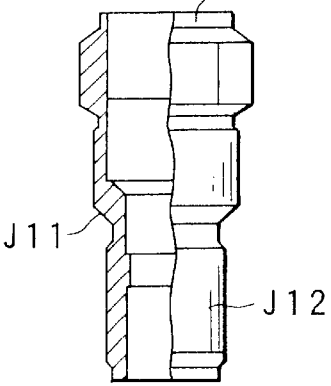
FIG. 9G PRIOR ART

Next, the forged product 7 is placed in the second forming station (not shown in the figure) to produce the next forged product 8, shown in FIG. 8B, by means of extrusion molding. A large hole 8*a* is formed at the upper end, and a small hole is formed at the lower end of the forged product 8. Additionally, a circular head part 8*c* is formed at the upper end, and a circular foot part 8*d*, having a smaller outer diameter than the head part, is formed at the lower end of the forged product 8. A step 8*e* is formed between the head part 8*c* and the foot part 8*d*. This forged product 8 corresponds to what is referred to as a columnar material in this invention.

Figure 4A:
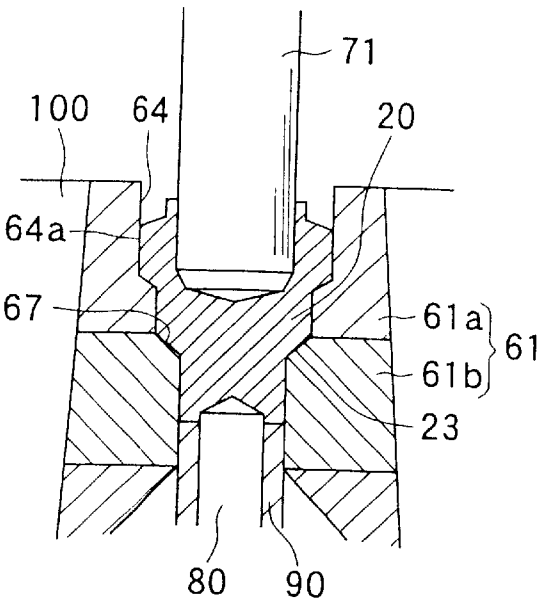
FIG. 4A is a cross-sectional views of a cold forging machine used in a method for making metallic shells for sparkplugs according to the present invention.
Figure 4B:
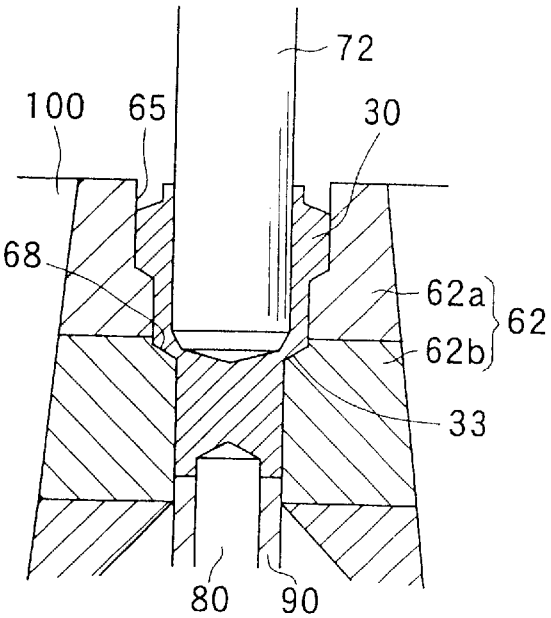
FIG. 4B is a cross-sectional views of a cold forging machine used in a method for making metallic shells for sparkplugs according to the present invention.
Figure 4C:
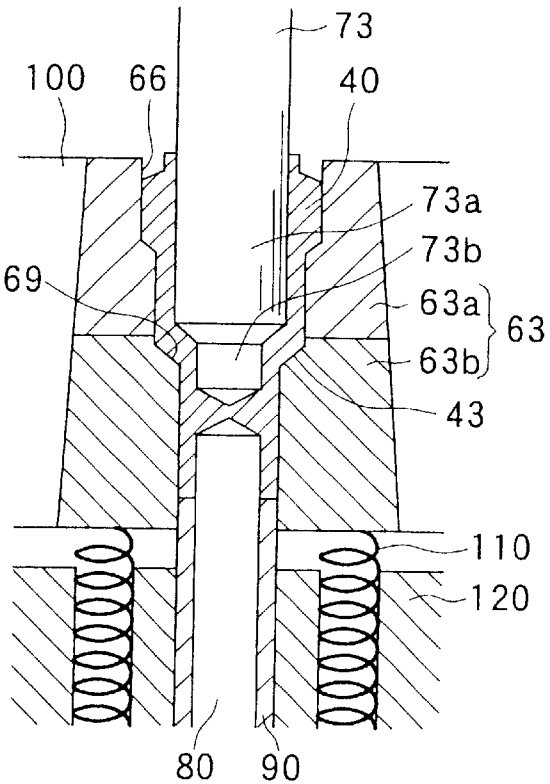
FIG. 4C is a cross-sectional views of a cold forging machine used in a method for making metallic shells for sparkplugs according to the present invention.

Next, the tapered part is produced by cold forging. FIG. 4A shows the third forming station of the cold forging machine and the cross section of each part. FIG. 4B shows the fourth forming station of the cold forging machine and the cross section of each part. FIG. 4C shows the fifth forming station of the cold forging machine and the cross section of each part. In FIGS. 4A–4C, parts 20, 30, and 40 are shown in their finished state.

In FIGS. 4A 4C, numerals 61, 62, and 63 indicate the first molding die (first forming mold), the second molding die (second forming mold), and the third molding die (third forming mold), respectively. In each of the molding dies 61 through 63, 61*a*, 62*a*, and 63*a* indicate the upper mold, and 61*b*, 62*b*, and 63*b* indicate the lower mold. Each molding die, 61 through 63, is a composite of a separate upper and lower molds.

Each molding die 61 through 63, has a stepped inner cavity 64, 65, and 66 where the parts to be processed is inserted. The stepped inner cavities 64 through 66, are formed by boring through both the upper molds, 61*a* through 63*a*, and the lower molds, 61*b* through 63*b*. In the upper mold, the large diameter part, and in the lower mold, the small diameter part is formed. In each stepped inner cavity 64 through 66, a tapering bearing surface (tapered bearing surface) is formed at the boundary between the large diameter part and the small diameter part.

The bearing surfaces are formed in different tapering angles. The bearing surface 67 (first bearing surface) has a tapering angle A (first tapering angle A). The bearing surface 68 (second bearing surface) has a tapering angle B (second tapering angle B), and the bearing surface 69 (third bearing surface) has a tapering angle C (third tapering angle C). The second tapering angle B is greater than the first tapering angle A, and the third tapering angle C is smaller than the second tapering angle B. These tapering angles can be set, for example as, A=58°, B=64°, and C=63°.

In FIGS. 4A 4C, numerals 71, 72, and 73 indicate the first punch (first punch part), second punch (second punch part), and third punch (third punch part) that press their respective material to be processed. They can be moved in a vertical direction or up and down as shown in the figure. They are arranged to apply pressure, in the axial direction, to the material to be processed placed in the forming mold.

Figure 5:
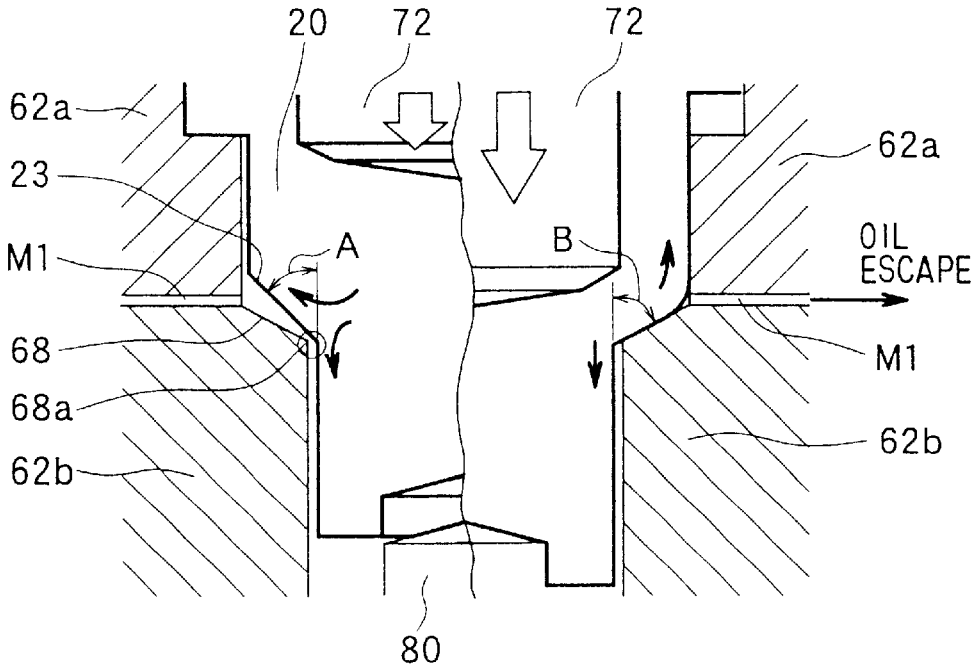
FIG. 5 is a cross-sectional view of a cold forging machine using a second processing for method for making metallic shells for sparkplugs according to the present invention.

Numeral 80 indicates a pin (mandrel) that supports the material processed and secures it inside the stepped inner cavity, 64 through 66. Numeral 90 indicates a kick-out sleeve that ejects the material processed, out of the molding die after casting is complete, and positions the processed material to determine its overall length. Numeral 100 indicates a molding die holder that holds the molding dies 61 through 63. Additionally, as shown in FIG. 5, a lubricating oil escape groove (discharge hole) M1 is provided between the upper and lower molds of each molding die to discharge the lubricating oil used in cold forging.

In the fifth forming station of the cold forging machine, a moving mechanism, 110 and 120 are provided, as shown in FIG. 4C. Numeral 110 indicates a spring, and numeral 120 indicates a spring guide that holds the spring in place. The third molding die 63 is pushed by the elastic force of the spring 110 in a direction opposite (upward in the figure) from the direction in which the third punch 73 is inserted.

Figure 3B:
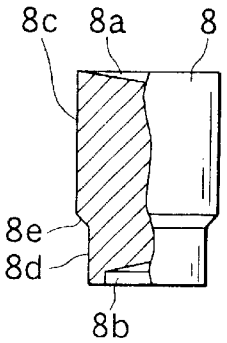
FIG. 3B is a partial cross-sectional view of a piece formed with a processing step of a method for making metallic shells for sparkplugs according to the present invention.
Figure 3C:
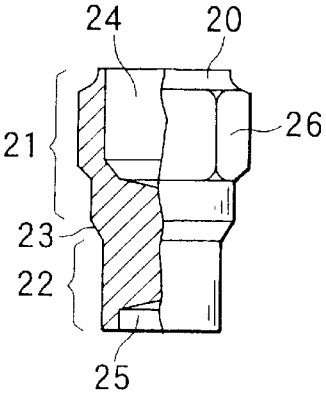
FIG. 3C is a partial cross-sectional view of a piece formed with a processing step of a method for making metallic shells for sparkplugs according to the present invention.

The first processing step of the cold forging operation of the tapered part. The forged product (columnar material) 8 shown in FIG. 3B is secured by the stepped inner cavity 64 of the first molding die 61. The forged product 8 is then transformed by the first punch 71 pressed against the forged product 8 in the axial direction (See FIG. 4A). The large diameter part of the stepped inner cavity 64 has a shape of hexagonal large diameter part 64*a* to form the hexagonal part 14. The first processed part 20 having a stepped columnar shape, shown in FIG. 3C, is produced in this manner.

The first processed part 20 produced in this manner comprises a large diameter head part 21 formed at one end, and a small diameter foot part 22 formed at the other end. The small diameter foot part 22 has an outer diameter smaller than that of the large diameter head part 21. It also comprises a first tapered part 23 having a tapering shape located at the boundary between the large diameter head part 21 and the small diameter foot part 22. The large diameter head part 21 has a large diameter hole 24 opened at the edge of one end. The small diameter foot part 22 has a small diameter hole 25 whose inside diameter is smaller than the large diameter hole 24, opened at the edge of the other end. Additionally, a hexagonal large diameter part 26 is formed in the large diameter head part 21 which will become the hexagonal part 14. The tapering angle of the first tapered part 23 forms a first tapering angle A, which is approximately the same as that of the bearing surface 67 (first bearing surface) of the first forming mold 61.

(The second processing step of the cold forging operation of the tapered part.) Next, the first processed part 20 is secured by the stepped inner cavity 65 of the second molding die 62, and the second punch 72 is inserted into the large diameter hole 24 of the first processed part 20. The first processed part 20 is pressed by the second punch 72 in the axial direction to transform the first tapered part 23 to conform to the bearing surface 68 (second bearing surface)

of the second molding die 62. In this manner, a second tapering angle B, which is larger than the first tapering angle A is formed (See FIG. 4B). Here, the outer diameter of the second punch 72 corresponds with the diameter of the large diameter hole 24 of the first processed part 20, but it is larger than the outer diameter of the small diameter foot part 22.

Figure 3D:
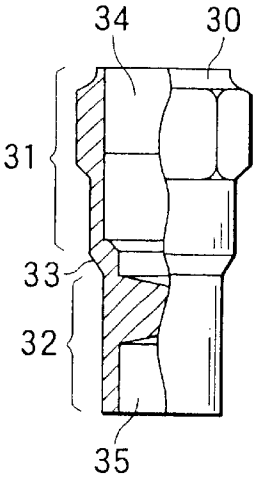
FIG. 3D is a partial cross-sectional view of a piece formed with a processing step of a method for making metallic shells for sparkplugs according to the present invention.

The second processed part 30, having a stepped columnar shape, shown in FIG. 3D, is produced in this manner. The large diameter head part and the small diameter foot part of the first processed part 20 are forced to stretch in the axial direction by the pressure of the second punch 72. Consequently, the large diameter head part 31, small diameter foot part 32, large diameter hole 34, and the small diameter hole 35 of the second processed part 30 has different dimensions than the first processed part 20. The tapering angle of the second tapered part 33 located between the large diameter head part 31 and the small diameter foot part 32 is the same as that of the second bearing surface 68. This forms the second tapered angle B.

The third processing step of the cold forging operation of the tapered part. Next, the second processed part 30 is secured by the stepped inner cavity 66 of the third molding die 63. The third punch 73 is inserted from its tip into the large diameter hole 34 of the second processed part 30. The second processed part 30 is pressed by the third punch 73 in the axial direction to transform the second tapered part 33 to conform to the bearing surface 69 (third bearing surface) of the third molding die 63. In this manner, a third tapering angle C, which is smaller than the second tapering angle B is formed (See FIG. 4C).

The third punch 73 comprises a larger diameter part 73*a* whose diameter is approximately the same as that of the large diameter hole 34 of the second processed part 30. It also comprises a smaller diameter part (tip part) 73*b* whose diameter is smaller than that of the larger diameter part 73*a* and located at the tip of the larger diameter part 73*a*. Additionally, the outer diameter of the smaller diameter part (tip part) 73*b* is made smaller than the outer diameter of the small diameter foot part 32 of the second processed part 30. In other words, the smaller diameter part 73*b* can be inserted inside the small diameter foot part 32 of the second processed part 30.

Figure 3E:
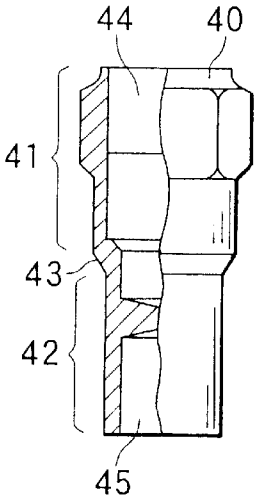
FIG. 3E is a partial cross-sectional view of a piece formed with a processing step of a method for making metallic shells for sparkplugs according to the present invention making metallic shells for sparkplugs according to the present invention.

The third processed part 40 having a stepped columnar shape, shown in FIG. 3E, is produced in this manner. The large diameter part and the small diameter part of the second processed part 30 are forced to stretch out in the axial direction by the pressure of the third punch 73. Consequently, the large diameter head part 41, small diameter foot part 42, large diameter hole 44, and the small diameter hole 45 of the third processed part 40 have different dimensions compared with those of the second processed part 30. In addition, the tapered angle of the third tapered part 43, located between the large diameter head part 41 and the small diameter foot part 42, is approximately the same as that of the third bearing surface 69. This forms a third tapering angle C.

Now the second and third processing steps of producing the tapered part by cold forging operation will be described in more detail referring to FIG. 5 through FIG. 8. FIG. 5 shows the second processing step. The initial stage of the second processing step is shown on the left side of the dotted line and the final stage is shown on the right side of the dotted line. In the initial stage of the second processing step, the first tapered part 23 of the first processed part 20 formed in the first processing step comes in contact with the second bearing surface 68 of the second molding die 62.

Here, the first tapered part 23 was made to form the first tapered angle A in the first processing step. Additionally, the tapering angle of the second bearing surface 68 was made to form the second tapering angle B that is greater than the tapering angle A of the first tapered part 23. Consequently, in the initial stage of the second processing step, the first tapered part 23 will contact only the inside corner 68*a* of the second bearing surface 68, as shown in the left side of FIG. 5.

Then, as cold forging of the first processed part 20 progresses, the first tapered part 23, initially contacting only the inside corner 68*a* of the second bearing surface, is gradually transformed. The transformation spreads from the inside toward the outside to form a tapered shape conforming to the second bearing surface 68. As the process progresses, the cold forging lubricating oil retained between the first tapered part 23 and the second bearing surface 68 is pushed outward from the inside as the first tapered part 23 is transformed. Finally, it is discharged from the escape groove of oil M1 provided in the second molding die 62.

The lubricating oil is discharged by the transformation of the first processed part 20 in this manner. It is not retained in the first tapered part 23. Therefore, it is effective in maintaining the smooth surface of the tapered part 15 formed 20 until the process is finished.

If the first tapering angle A and the second tapering angle B were the same, the second bearing surface 68 and the whole first tapered part 23 will be in contact from the beginning of the cold forging of the first processed part 20. Consequently, the lubricating oil will have nowhere to escape, and it will be retained in the space between the first tapered part 23 and the second bearing surface 68. This obstructs the formation of the second tapered part 33 with a desirable shape for the second processed part 30. Additionally, when the first tapering angle A is greater than the second tapering angle B, clearly the effect mentioned above cannot be expected.

In addition, the difference between the tapering angles A and B preferably should be about 1° to 10°. If the angle difference were less than 1°, there will be little time for the lubricating oil to escape, and causes it to be retained in the space between the tapered part and the bearing surface. If the angle difference were greater than 10°, the quantity of lubricating oil retained in the space between the tapered part and the bearing surface will be so much that it will be difficult to discharge all of it.

Figure 6:
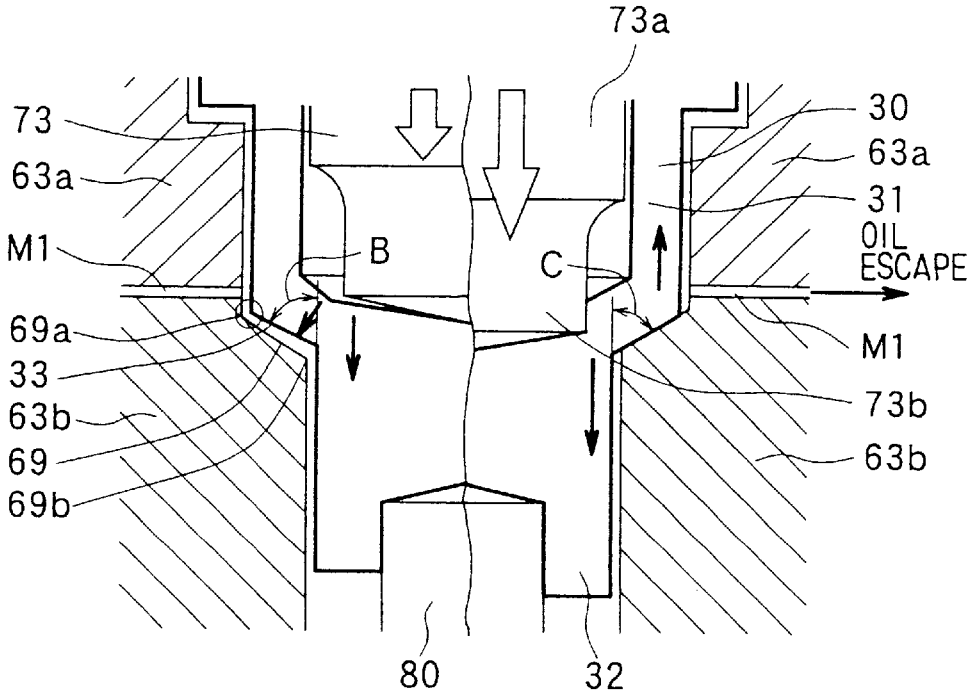
FIG. 6 is a cross-sectional view showing the third processing step forming a third tapered part with a method for making metallic shells for sparkplugs according to the present invention.
Figure 7:
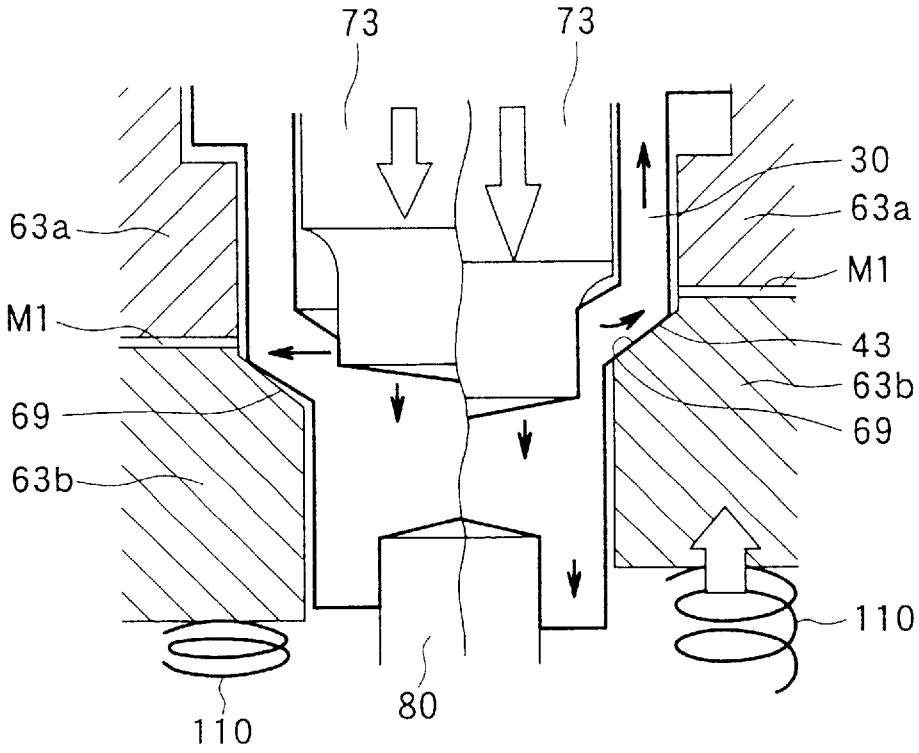
FIG. 7 is a cross-sectional view showing the third processing step for a method for making metallic shells for sparkplugs according to the present invention.

FIG. 6 and FIG. 7 explain the third processing step. On the left side of the dotted line in FIG. 6, the initial stage of the third processing step is shown. On the right side of the dotted line in FIG. 6, and on the left side of the dotted line in FIG. 7, the intermediate stage of the third processing step is shown. On the right side of FIG. 7, the finished stage of the third tapered part is shown. The tapering angle of the second tapered part 33 of the second processed part 30, shown in FIG. 6, is the second tapering angle B. The tapering angle of the third bearing surface 69 of the third molding die in the third processing step is the third tapering angle C which is smaller than the second tapering angle B. The third tapering angle C is approximately the same as the tapering angle formed in the final finished product.

In the initial stage of the third processing step, the second tapered part 33 of the second processed part 30 contacts the outside corner 69*a,* of the third bearing surface 69 of the third molding die 63, as shown on the left side of FIG. 6. Then, as the process progresses, the second processed part 30 begins to transform by the pressure of the third punch 73.

The second tapered part 33 also begins to transform conforming to the third bearing surface 69. Since the third tapering angle C is smaller than the second tapering angle B, the material of large diameter head part (trunk part) 31 can flow easily into the small diameter foot part 32 to stretch the small diameter foot part (reach part) 32 of the second processed part 30.

It is preferable to have the difference between the second tapered angle B and the third tapered angle C between 0.5° to 5°. If the difference between the tapering angles were less than 0.5°, or if the second and third tapering angles were the same, a strong shearing stress is created between the third bearing surface 69 and the smaller diameter part 73*b* of the third punch 73, when the third punch is inserted. Consequently, 20 there is a risk of shearing off the root of the small diameter foot part (reach part) 32 of the second processed part 30. If the difference in the tapering angle were greater than 5°, excessive lubricating oil will be retained in the space between the third bearing surface 69 and the second tapered part 33. This makes it difficult to produce a tapered part with smooth surface.

Additionally, when the third tapered angle C is greater than the second tapered angle B, the point initially receiving the force exerted between the second tapered part 33 and the third bearing surface 69 will be the inside corner 69*b*. This is because the diameter of the smaller diameter part 73*b* of the third punch 73 is smaller than the diameter of the small diameter foot part (reach part) 32. The inside corner 69*b* is opposite from the outside corner 69*a*, as shown in FIG. 6. Consequently, the transformation of material becomes difficult outside the fulcrum of force exerted onto the second tapered part 33 of the second processed part 30. This makes it difficult to obtain the desired tapered shape.

In the second processing step, the first tapering angle A of the processed part had to be smaller than the second tapering angle B of the bearing surface. Why is this not true in the third processing step? The answer is in the tip diameter of the punch. In other words, in the second processing step, the diameter of the tip of the second punch 72 is greater than the diameter of the small diameter foot part (reach part) 22 of the first processed part 20. This can be seen in FIG. 5. Therefore, the pressure (suppression force) exerted on the first processed part 20, is directly conveyed to the first tapered part 23.

In the third processing step, however, the diameter of the smaller diameter part (tip part) 73*b* of the third punch 73 is smaller than the diameter of the small diameter foot part (reach part) of the second processed part 30. Therefore, the pressure (suppression force) exerted to the second processed part 30, is not conveyed directly to the second tapered part 33.

The second tapered part 33 is transformed by being stretched by the transformation of the small diameter foot part 32. The third tapered part 43 is produced as a final finished tapered part having a third tapering angle C, in this manner. The configuration of pressure applied to the tapered part in the third processing step is different from that in the second processing step. Consequently, lubricating oil is less likely to be retained here although the third tapering angle C is smaller than the second tapering angle B. Hence, the optimum tapering angles are different in the two processing steps.

Additionally, even after the formation of the third tapered part 43 is completed by the third punch 73, the third punch 73 continues to be inserted further. This action continues as the third tapered part 43 and the third bearing surface 69 of the third molding die 63 remain in contact, as illustrated on the right side of FIG. 7. Here, the third molding die 63 is pressed in a direction opposite from the direction of pressure applied by the third punch 73, by a moving mechanism 110 and 120. By this arrangement, the third bearing surface 69 is always kept in contact with the third tapered part 43 that was just formed.

It is difficult to stop the pressure of the third punch 73 immediately after the third tapered part 43 is formed. Also, the pressure (insertion) of the third punch 73 is maintained after the third tapered part 43 is formed to form the reach part that later becomes the threaded part 13 of the metallic shell 10. If the moving mechanism described above were not provided, a gap is created between the tapered part 43 and the bearing surface 69. The gap is created by the pressure (suppression force) of the third punch 73, as the tip of the third punch 73 passes through the third tapered part 43. As the large diameter head part 31 is stretched in a direction opposite from the direction of punch insertion, a bulge K1 is created at the tapered part 43.

Figure 3F:
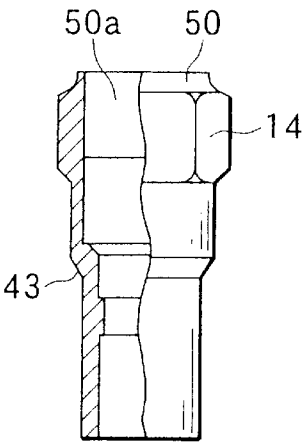
FIG. 3F is a partial cross-sectional view of a piece formed with a processing step of a method for making metallic shells for sparkplugs according to the present invention.

A third processed part 40, having a tapered part 43 that corresponds with the final finished tapered part, is produced in this manner after going through the first through the third processes described above. Next, it is inserted in the sixth forming station (not illustrated) of the cold forging machine. A large diameter hole 44 and the small diameter hole 45 of the third processed part 40 are bored by punching operation. A forged product 50, having a third tapered part 43, between the large diameter part and the small diameter part, and a penetrating hole 50*a*, as shown in FIG. 3F, is obtained.

Then, a thread 13 is formed on the small diameter foot part, of the forged product 50, by thread rolling. A final product of the metallic shell 10, shown in FIG. 1, is completed in this manner. A grounding electrode is welded onto the metallic shell 10, and an insulator 2, containing a center electrode 3 in its center, is fixed inside the metallic shell 10 by caulking. The spark plug 1 shown in FIG. 2 is assembled in this manner.

In the first through the third processing steps of the cold forging operation made to produce the tapered part in this embodiment, compound casting comprising cold forging swaging and extrusion forming have been performed. As described above, specially devised molding dies to process the tapering angles and the bearing surface of the processed material have been utilized in the casting. Deformation of the tapered part caused by the presence of lubricating oil, used in cold forging, retained between the molding die and the tapered part can be prevented by the method of this embodiment. Consequently, a method of manufacturing the metallic shells for spark plugs whose tapered part can be formed in desired shapes by utilizing cold forging operation can be presented.

In addition, since the tapered part of the conventional metallic shell has been produced by cutting operation, marks of cutting tools were left on the surface of the tapered part. Consequently, there has been a limit on producing a smooth surface. According to this embodiment, since the tapered part is produced by the cold forging operation, there are no marks of tools left on the surface, and the surface roughness of the tapered surface can be improved. Consequently, the sealing performance of the tapered part can be improved.

While the above-described embodiments refer to examples of usage of the present invention, it is understood that the present invention may be applied to other usage, modifications and variations of the same, and is not limited to the disclosure provided herein.

What is claimed is:

1. A method of cold forging a metallic shell for a spark plug, an outer periphery of said shell having a tapered stepped portion between a large diameter part and small diameter part, to provide a seal when attached to an engine, said method comprising the steps of:

securing a columnar material in a stepped inner cavity of a first molding die;

pressing a first punch against said material in an axial direction to transform a shape of said material into a first processed part having a tapered bearing surface between the large diameter part and small diameter part, said first processed part having a large diameter head part and large diameter hole at one end and a small diameter foot part positioned at an opposite end of said head part and said large diameter hole, the small diameter foot part having a smaller outer diameter than an outer diameter of the large diameter head part, said first processed part having a first tapered part formed at a boundary between said large diameter head part and said small diameter foot part;

securing the first processed part in a stepped inner cavity of a second molding die, said second molding die having a stepped inner cavity, said second molding die having a tapered bearing surface with a greater tapering angle than a tapering angle of the first tapered part;

Inserting a second punch into the larger diameter hole of the first processed part to form a tapered bearing surface at the boundary between the large diameter part and the small diameter part, said second punch having a larger outer diameter than that of the small diameter foot part of the first processed part, said second punch pressing in an axial direction and transforming a shape of said first tapered part to conform to the bearing surface of the second molding die to create a second processed part having a stepped columnar shape and a second tapered part with the second tapering angle;

securing the second processed part in a stepped inner cavity of a third molding die, said third molding die having a stepped inner cavity that forms a tapered bearing surface at the boundary between the large diameter part and the small diameter part, the tapered bearing surface having a smaller tapering angle than the tapering angle in the second tapered part; and inserting and axially pressing a third punch into the large diameter hole in the second processed part to transform said second tapered part to conform to the bearing surface of the third die to form the third processed part into a stepped columnar shape and into a third tapered part with a tapered angle having a third tapering angle smaller than the second tapering angle of the second tapered part, said third punch having an outer diameter of a tip that is smaller than the small diameter foot part of the second processed part.

2. A method as claimed in claim 1, wherein the third molding die is pressed in a direction opposite to a direction of pressure applied by the third punch, whereby the third tapered part and the bearing surface of the third molding die remain in contact after the third tapered part is formed.

3. A method as claimed in claim 1, wherein the second tapering angle is greater than the first tapering angle by a range of approximately 1° to 10°.

4. A method as claimed in claim 1, wherein the third tapering angle is smaller than the second tapering angle by a range of approximately 0.5° to 5°.

5. A method as claimed in claim 1, wherein the first, second, and third molding dies are composites of split type dies able to be separated near the bearing surface.

* * * * *